US010683864B2

(12) United States Patent
Heaps et al.

(10) Patent No.: US 10,683,864 B2
(45) Date of Patent: Jun. 16, 2020

(54) TWIN VANE ROTARY VACUUM PUMP

(71) Applicant: WABCO EUROPE BVBA, Brussels (BE)

(72) Inventors: David Heaps, Haworth (GB); Simon Warner, Pontefract (GB); Paul Wellings, Upton (GB)

(73) Assignee: WABCO EUROPE BVBA, Brussels (BE)

( * ) Notice: Subject to any disclaimer, the term of this patent is extended or adjusted under 35 U.S.C. 154(b) by 0 days.

(21) Appl. No.: 16/068,902

(22) PCT Filed: Mar. 10, 2016

(86) PCT No.: PCT/EP2016/000428
§ 371 (c)(1),
(2) Date: Jul. 10, 2018

(87) PCT Pub. No.: WO2017/152923
PCT Pub. Date: Sep. 14, 2017

(65) Prior Publication Data

US 2019/0017507 A1 Jan. 17, 2019

(51) Int. Cl.
*F04C 18/344* (2006.01)
*F01C 21/08* (2006.01)
*F04C 25/02* (2006.01)

(52) U.S. Cl.
CPC ..... *F04C 18/3441* (2013.01); *F01C 21/0809* (2013.01); *F01C 21/0854* (2013.01);
(Continued)

(58) Field of Classification Search
CPC ..... F01C 21/08; F01C 21/00; F01C 21/0827; F02B 1/04; F04C 18/3441;
(Continued)

(56) References Cited

U.S. PATENT DOCUMENTS 1,290,251 A * 1/1919 Leiman et al. ..... F01C 1/3562 418/223
4,051,893 A * 10/1977 Guibert ..... F24F 9/00 165/125

(Continued)

FOREIGN PATENT DOCUMENTS

DE 3004676 A1 8/1981
DE 4019854 A1 1/1991

(Continued)

OTHER PUBLICATIONS

English Machine Translation of DE 4019854 A1, Translated on Nov. 11, 2019 from Espacenet.*

*Primary Examiner* — Patrick Hamo
*Assistant Examiner* — Paul W Thiede
(74) *Attorney, Agent, or Firm* — Leydig, Voit & Mayer, Ltd.

(57) ABSTRACT

Vacuum pump (1), comprising a housing (2) having an inlet (4) and an outlet (6) and defining a chamber (8) within the housing (2), a rotor (10) for rotational movement about a rotational axis (AR) within the chamber (8), and at least a first and a second vane (22, 24) received in respective first and seconds slots (16, 18) formed in the rotor (10). The first and second slots (16, 18) are substantially parallel to each other, and a length ($L_V$) of each vane (22, 24) is larger than a length ($L_S$) of the respective slot. Production method of such a vacuum pump.

20 Claims, 7 Drawing Sheets

(52) U.S. Cl.
CPC ..... *F04C 25/02* (2013.01); *F04C 2230/25* (2013.01); *F04C 2230/60* (2013.01); *F04C 2240/20* (2013.01); *F04C 2240/30* (2013.01); *F04C 2250/301* (2013.01); *F04C 2270/701* (2013.01)

(58) Field of Classification Search
CPC .... F04C 2270/052; F04C 25/02; F04C 28/06; F04C 29/02; F04C 18/344
USPC ... 418/234, 258, 269, 17, 23, 151, 160, 223, 418/238; 417/423.1; 60/397, 428
See application file for complete search history.

(56) References Cited

U.S. PATENT DOCUMENTS

| | | | | | |
|---|---|---|---|---|---|
| 4,428,195 | A * | 1/1984 | Linder | F04C 18/3441 | 418/151 |
| 5,409,360 | A * | 4/1995 | Wycliffe | F01C 21/08 | 418/234 |
| 8,979,504 | B2 * | 3/2015 | Snider | F04D 29/026 | 417/423.1 |
| 9,651,042 | B2 * | 5/2017 | Blank | F01C 21/0827 | |
| 2014/0030130 | A1 * | 1/2014 | Labbett | F04C 15/0038 | 418/160 |
| 2016/0006303 | A1 * | 1/2016 | Hoemann | H02K 1/2773 | 310/45 |

FOREIGN PATENT DOCUMENTS

| | | | | |
|---|---|---|---|---|
| DE | 4020082 | A1 * | 1/1991 | F01C 21/08 |
| GB | 203917 | A | 9/1923 | |
| JP | H 10196576 | A | 7/1998 | |

* cited by examiner

TWIN VANE ROTARY VACUUM PUMP

CROSS REFERENCE TO RELATED APPLICATIONS

This application is a U.S. National Stage Application under 35 U.S.C. § 371 of International Application No. PCT/EP2016/000428 filed on Mar. 10, 2016. The International Application was published in English on Sep. 14, 2017, as WO 2017/152923 A1 under PCT Article 21(2).

FIELD

The invention relates to a vacuum pump. Moreover the present invention provides a production method for manufacturing a vacuum pump of the aforementioned type.

BACKGROUND

Vacuum pumps may be fitted to road vehicles with gasoline or diesel engines. Typically, the vacuum pump is driven by a cam shaft of the engine. Therefore, in most vehicles the vacuum pump is mounted to an upper region of the engine. But also configurations where the vacuum pump is mounted to a lower region of the engine are known. In general, two different construction types of vacuum pumps are known, one is the type incorporating a movable piston, and the other is the vane pump. Nowadays, in particular vane pumps are broadly established.

A vane pump of the aforementioned type typically comprises a housing having an inlet and an outlet and defining a chamber within the housing. Moreover it comprises a rotor for rotational movement about a rotational axis within the chamber. This rotor usually is offset with respect to a central axis of the housing, and typically mounted adjacent, or contacting, an inner circumferential wall of the chamber. The rotor drives at least one vane to draw fluid through the inlet into the chamber and out of the chamber through the outlet, so as to induce a reduction in pressure at the inlet. The inlet is connectable to a consumer such as a brake booster or the like. The outlet normally is connected to the engines crankcase, thus the exhaust air is consumed by the engine, via the P.C.V system.

Known in the art are so-called mono-vane pumps or single vane pumps, comprising one single vane, which extends in a radial direction through the whole rotor, so as to project outward on both sides of the rotor and to contact with both vane tips the inner circumferential wall of the chamber. Mono-vane pumps having a rigid vane in general have the drawback that the freedom in designing the profile of the chamber, which is defined by the inner circumferential wall of the chamber, is limited. The profile needs to be formed according to a conchoid of a circle, such that the vane is able to rotate while still contacting with both vane tips the inner wall and to seal against the inner wall accordingly.

To meet such a drawback it has been proposed in DE 40 19 854 to use a single vane which is split in radial direction by a double L-shaped cut. Each tip of the single vane can move independently on the other tip to a certain extent and the profile of a chamber can be designed with a higher degree of freedom. However, a drawback of such a design is the sealing of both parts of the vane against each other as well as the design of the vane tip which is dependent on the split vane arrangement.

Moreover, also multi-vane pumps are known having a plurality of vanes which are provided in a radial or non-radial manner in the rotor and movable independent from each other. With such a multi-vane pump the inner circumferential wall and thus the chamber profile can be designed with a great degree of freedom.

DE 300 46 76 discloses an engine, comprising a chamber and a rotor within the chamber, as well as two movable vanes. The rotor is centrally provided within the chamber so as to form a rotary engine. Each vane can move with its whole length into the respective recess in the rotor and is provided with a spring, so that the vane is biased into an extended position. This design has the drawback that the rotor needs to be large to form two sealing points so as to divide the chamber into sub-chambers and to provide sufficient space, so that the vanes can dive with their whole length into the rotor body. This leads to certain restrictions.

SUMMARY

In an embodiment, the present invention provides a vacuum pump. The vacuum pump includes a housing having an inlet and an outlet, a chamber within the housing, a rotor configured to undergo rotational movement about a rotational axis within the chamber, and at least a first vane and a second vane. The first vane and the second vane are received, respectively, in a first slot and a second slot. The first slot and the second slot are formed in the rotor. The first slot and the second slot are substantially parallel to each other. A length of the first vane is greater than a length of the first slot, and a length of the second vane is greater than a length of the second slot.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
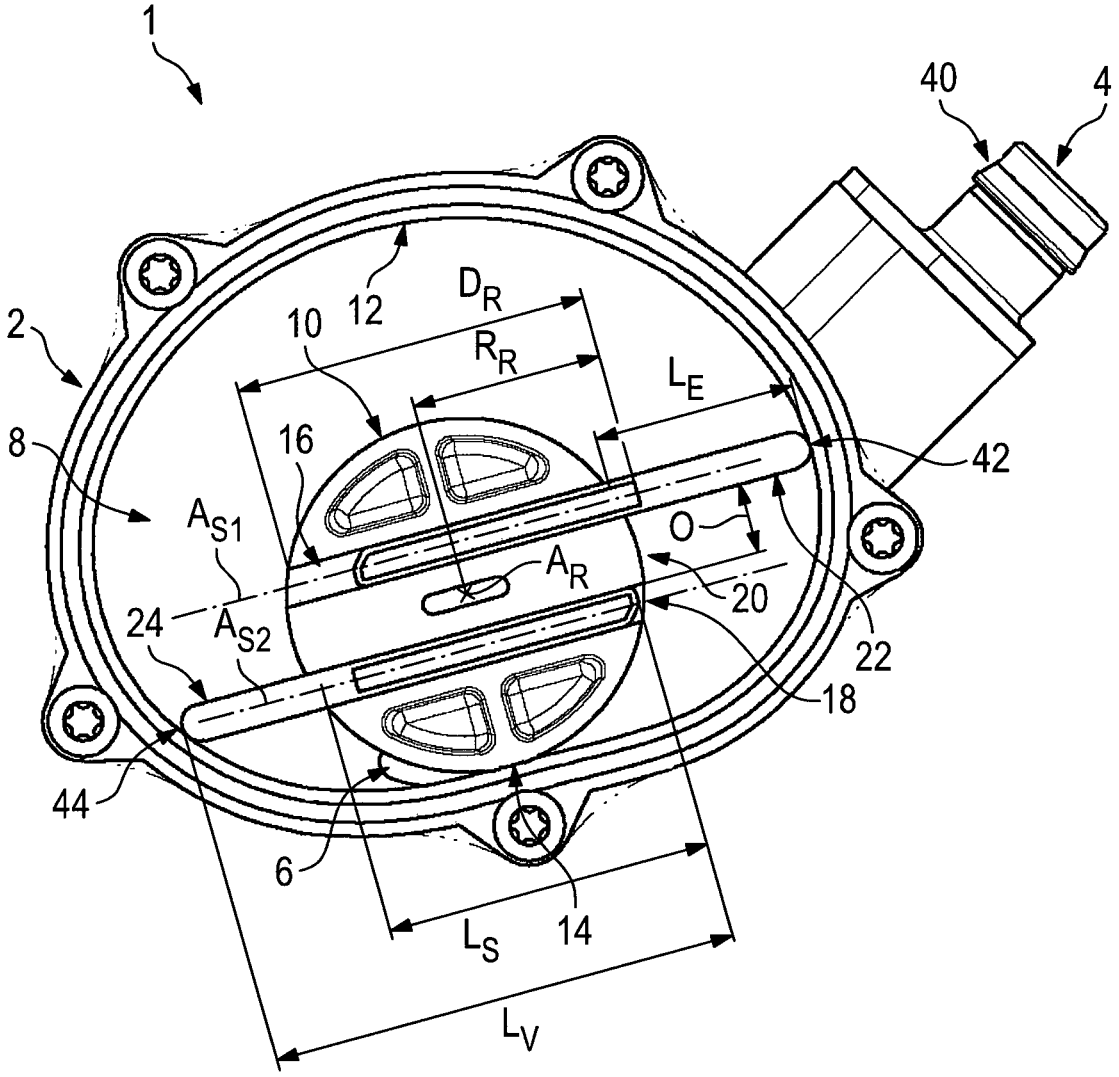
FIG. 1 shows a top view of a vacuum pump with opened housing.

Embodiments of the present invention provide vacuum pumps that allow for flexibility with regard to the design of the chamber profile, a relatively large chamber volume with respect to the rotor, and, in particular, the ability to start with a low torque—even at lower temperatures.

According to an embodiment of the invention, a vacuum pump is provided that includes a housing having an inlet and an outlet and defining a chamber within the housing, a rotor for rotational movement about a rotational axis within the chamber, and at least a first and a second vane received in respective first and second slots formed in the rotor. The first and second slots in the rotor are substantially parallel to each other and a length of each vane is larger than a length of the respective corresponding slot.

Having two vanes which are movable independent from each other allows the pump to start with low torque when oil within the pump is still highly viscous. In this state, the vanes do not need to displace the oil, as it is necessary in rigid mono-vane pumps, much more the vanes can retract slightly so as to slide over the oil. While there are limitations with regard to the design of the chamber profile in both, the mono-vane pumps known in the art and the multi-vane pumps known in the art, embodiments of the present invention provide the vanes with a length which is larger than a length of the respective slot. Thus, when retracted and the vane tip is within the slot of the rotor, the opposing foot end of the vane will protrude out of the rotor. For any given rotor diameter, greater vane extension compared to the rotor diameter is possible by this arrangement compared to a conventional multi-vane pump which means that the proposed pump has a greater chamber volume. Therefore, the overall size of the vane pump is greatly reduced compared to a multi-vane pump while still maintaining the low cold starting torque of the multi-vane pump.

According to a first preferred embodiment, the slots are formed as secants and symmetrical to each other with respect to the rotational axis of the rotor. Thus, the vanes are slightly spaced from each other. The rotor has a solid central portion which gaps the slots from each other. The vanes do not extend in a radial direction of the rotor which is beneficial in view of tilting or canting of the vanes with respect to the slots. Thus, movement of the rotor and the vanes is simplified.

Moreover, it is preferred that a length of each vane is larger than the diameter of the rotor. Preferably the length of each vane is larger than the diameter of the rotor by 10%, 20%, 30%, 50% or more. In particular, a value of approximately 30% has proven in practice to be beneficial. Due to such an arrangement, the efficiency can be increased, since the volume of the chamber compared to the volume of the rotor is large.

An aspect of the invention which also adds to this fact is, when a ratio of the external vane length and the radius of the rotor is in the range of 1.0 to 1.3. Preferably, this ratio is in the range of 1.11. The external vane length is the length of the vane which projects out of the rotor at the maximum position. This is the effective wavelength for displacing fluid. However, it is also important that the vane has a certain length within the slot of the rotor, to provide support and bearing for the external portion of the vane. This helps to avoid tilting and canting and reduces wear of the pump.

According to a particular preferred embodiment, a center of gravity of each vane is offset towards the respective vane tip. Each vane has a vane tip and a vane foot, wherein the vane tip is permanently in contact with the inner circumferential wall and sealing against it. Due to the fact that the center of gravity is offset towards the respective vane tip, the vane will be pressed against the inner circumferential wall when the rotor rotates. This is due to the centrifugal force. In mono-vane pumps this is not necessary, since the vane is rigid and extends from wall to wall. However, when multiple vanes are used, each vane is movable independent from each other and sealing between the vane tip and the inner circumferential wall needs to be ensured. In particular, when the slot extends continuously through the whole rotor it is beneficial when the center of gravity is offset towards the respective vane tip, such that the vane will not move toward the foot end of the vane by means of the centrifugal force.

In a preferred development of the invention, the rotor comprises first and second bridges, each bridge intersecting the respective slot for connecting the opposing portions of the rotor. When the slot is continuous, this slot would split the rotor in two halves. Therefore, these halves need to be connected. The bridges connect these parts.

In such an embodiment it is preferred that the vanes comprise respective recesses which correspond to the bridges, such that the vanes are able to slide within the slots. When the vanes have such a respective recesses, it is also simpler to offset the center of gravity towards the vane tip. It is beneficial when the recess is formed at the foot end of the vane. Thus, the bridge preferably is placed at a foot end of the respective slot.

Moreover, it is preferred when the bridges form abutments for restricting the movement of the vanes. When the slot is continuously formed and extending from one side to the other side of the rotor, in theory it would be possible that the vane moves to the wrong side, thus to the foot end, and in such a condition, the pump would not be able to induce any vacuum at the inlet. When the bridges form abutments for restricting the movement of the vanes, this condition is inhibited. This ensures that the pump will function correctly, even if in a start condition the vane tips are not in contact with the inner circumferential wall of the chamber.

Preferably, the abutments are formed such that the center of gravity of each vane is always kept on the same side of a radial plane through the rotor perpendicular to the slots. Thus, the center of gravity of each vane is always "on the correct side", which is the side such that the vane is moved in the direction of the vane tip and pressed against the inner circumferential wall with its vane tip into a sealing contact. The abutments are formed such that the center of gravity of each vane does not cross this plane.

According to a preferred embodiment the vacuum pump comprises additional biasing means for biasing at least the first or the second vane into an extended position. This in particular is beneficial for startup of the vacuum pump. When starting the vacuum pump, the rotation speed of the rotor will be low and thus also centrifugal forces on the vanes are low. Therefore, in the start-up phase the vane tips might not be in sealing contact with the inner circumferential wall and therefore no or no substantial vacuum will be induced at the inlet of the vacuum pump. The biasing means acts such that at least one, preferably both vanes are biased into the extended position and biased against the inner circumferential wall, such that the respective vane tips are in sealing contact with the inner circumferential wall. A vacuum can be induced also during the start-up phase.

Preferably, such biasing means comprises an oil supply to the back side of at least the first or the second vane. Alternatively the oil supply may be fed to at least one of the abutments formed by the bridges of the rotor. Normally, vacuum pumps are lubricated using an oil supply. This oil supply can be used to provide the vanes with a biasing force to push them outward.

Alternatively or additionally a spring or the like can be used.

In a further preferred development of the invention, the chamber comprises a chamber profile which has a circular arc portion corresponding to a section in a range of at least 90° to 135°, preferably at least 120° to 135°. This is measured with respect to the rotational axis of the rotor. The chamber profile is preferably formed such that a ratio of the chamber volume and the rotor volume is maximized and at the same time the vane tips are always pressed with a sufficient force against the inner circumferential wall to provide a sealing contact. When the two vanes can move independent from each other, the chamber profile can be designed as if it was a cam profile by specifying the blade extension at any given rotor angle. The chamber profile can be specified so that the maximum vane tip to wall force is controlled within an acceptable limit. Further, the chamber profile can be designed so that the vanes are extended as quickly as possible and stay out for as long as possible. By this embodiment, the maximum possible volume may be swept. While mono-vane pumps are restricted to a chamber profile which is formed according to a conchoid of a circle, the present invention is able to use any profile. Thus, it is preferred that the chamber profile is different from a conchoid of a circle. It is also possible that the chamber profile is asymmetrically arranged, so that the vanes go out quicker than they are arranged to go back into the slots, or vice versa.

Having a circular arc portion which along a large section, preferably 120° to 135°, reflects the fact that the vanes stay out for a long time, namely at least one third of the whole revolution of the rotor.

In a further preferred embodiment, the chamber profile comprises a widening portion, which may be a substantially straight portion, corresponding to a section in a range of 10° to 40°, preferably 25° to 35°. This widening portion is preferably in the area of the contact point of the rotor and the inner circumferential wall. At this contact point, the vane tip needs to slide fully into the rotor. This widening portion helps to bring in the vane tip as quickly as possible and out again as quickly as possible thus resulting again in a large volume of the chamber. Moreover, when the vane tips are moved out again quickly, the center of gravity of the vane moves further away from the rotational axis of the rotor, thus increasing the centrifugal force and thus the tip to wall force. This is beneficial for an effective sealing between the vane tip and the inner circumferential wall.

According to a further beneficial embodiment, the rotor is connected to a drive shaft by means of over molding. The rotor itself preferably is formed of a low density material, as e.g. a polymer, and the drive shaft is formed out of a rigid material which can be connected to a drive motor or the cam shaft of an engine. Moreover, the rotor has a complex form having the two slots and preferably bridges. Such a form can easily be manufactured by means of molding. The process of over molding is a very simple process for mounting the rotor directly to the drive shaft and thus resulting in a cost effective manufacturing of the vacuum pump.

Preferably, the drive shaft comprises a flattened tang portion extending into a central solid portion of the rotor. The rotor does not have a central slot as rotors have which are used for mono-vane pumps. However, the rotor has a substantially flat central solid portion which spaces the two slots from each other. This solid portion can be used for accommodating the tang of the drive shaft. If the drive shaft has such a tang, a form-fitting contact between the drive shaft and the rotor can be provided, and torque is easily transferred from the drive shaft to the rotor.

According to embodiments of the present invention, the production methods are provided for manufacturing a vacuum pump according to any of the above described preferred embodiments of a vacuum pump, comprising the steps of providing a housing having an inlet and an outlet and defining a chamber within the housing; providing a drive shaft; over molding a rotor on the drive shaft, the rotor having respective first and second slots, wherein the first and second slots are substantially parallel to each other; and providing a first and a second vane received in the respective first and second slots, wherein a length of each vane is larger than a length of the respective slots.

Moreover, it is preferred that the production method comprises the step: forging a flattened tang portion on the drive shaft before over molding the rotor.

This is a very simple production method which leads to a low manufacturing cost vacuum pump. Regarding the preferred embodiments and benefits of the vacuum pump, reference is made to the above-described embodiments of the vacuum pump according to the first aspect of the invention.

Referring to drawing in FIG. 1 there is shown a vacuum pump, generally designated 1, which is intended to be located adjacent to an automotive engine. The vacuum pump 1 comprises a housing 2 having an inlet 4 and an outlet 6. The housing 2 is shown without cover plate (see FIG. 2) thus leaving the view open to the inside chamber 8 of the vacuum pump 1.

A rotor 10 is provided within the chamber 8. The rotor 10 is placed close to the inner circumferential wall 12 of the chamber 8, so that the rotor 10 has a sealing contact point 14 with the inner circumferential wall 12. The rotor comprises first and second slots 16, 18, wherein longitudinal axes $A_{S1}$ and $A_{S2}$ of the first and second slots 16, 18 are arranged parallel to each other. The slots 16, 18 are arranged symmetrically about the rotational axis $A_R$ of rotor 10. The slots 16, 18 are offset from each other by an offset O, which is provided by a block portion 20 of the rotor 10.

Within the slots 16, 18 respective first and second vanes 22, 24 are received. Both vanes 22, 24 can slide along the axes $A_{S1}$, $A_{S2}$. The slots 16, 18 are formed as secants and not in a radial direction. As also can be seen in FIG. 1, a length $L_V$ of each vane 22, 24 (length $L_V$ only shown with vane 24) is larger than the length $L_S$ of the respective slot. In the exemplary embodiment in FIG. 1, length $L_V$ is approximately 30% larger than length $L_S$. Moreover the length $L_V$ of each vane 22, 24 is larger than the diameter $D_R$ of the rotor 10. Preferably a ratio of the external vane length $L_E$ and the radius $R_R$ of the rotor 10 is in the range of 1.0 to 1.3.

Figure 2:
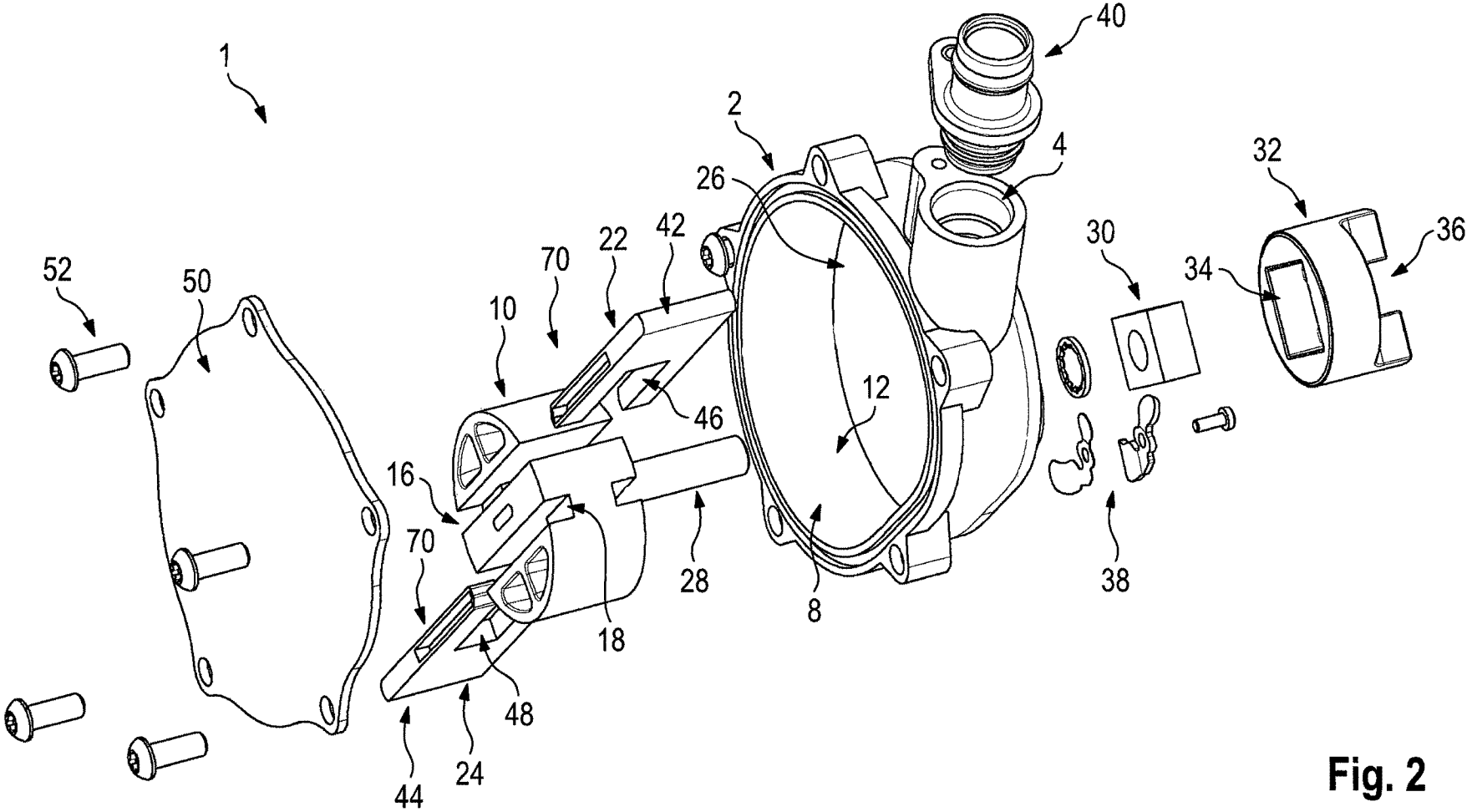
FIG. 2 shows a perspective exploded view of a vacuum pump.

With reference to FIG. 2, the vacuum pump 1 is shown in an exploded view, so that the single items of the vacuum pump can be seen. The housing 2 defines the chamber 8 and comprises an inner circumferential wall 12. This inner circumferential wall also defines the profile of the chamber. Moreover, housing 2 has a bottom wall 26, in which a through hole is formed (not shown) through which the drive shaft 28 for rotor 10 protrudes in an assembled condition. The drive shaft 28 is then received in a block 30 by means of a press fit, which again is received in a coupling 32 which comprises a corresponding recess 34, in which the block 30 is seated. The coupling 32 comprises formfitting means 36, by means of which the vacuum pump 1 can be connected to a drive motor, the cam shaft of an engine or the like.

The outlet 6 (see FIG. 1) is provided at an outside of the housing 2 with a valve assembly 38, forming a check valve, such that air can be pushed through the outlet, but no air enters the chamber 8 through the outlet. The inlet 4 is provided with a hose connector 40, such that it can be connected to a brake booster or the like.

Figure 7:
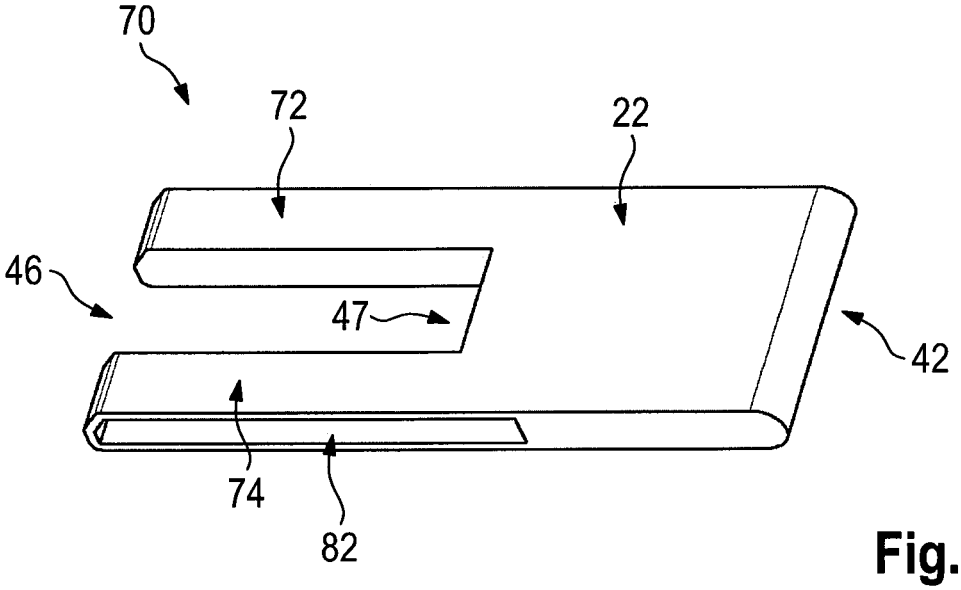
FIG. 7 shows a perspective view of a vane.

The vanes 22, 24 comprise respective vane tips 42, 44 which contact the inner circumferential wall 12 when in a working condition. Moreover, each vane 22, 24 comprises a recess 46, 48 formed at the opposite end of the vane tip 42, 44 of the respective vanes 22, 24. The structure of the vanes will be described with reference to FIGS. 7 and 8 in more detail.

The vacuum pump 1 comprises a cover 50 for closing the chamber 8. The cover 50 can be screwed to the housing 2 by means of screws 52, so that the chamber 8 is closed and sealed against the environment.

The rotor 10 comprises two bridges 54, 56 bridging the respective slots 16, 18. The bridges 54, 56 thus connect the central block portion 20 of the rotor 10 with two side portions 58, 60. The side portions 58, 60 are each provided with recesses 62 for weight reduction reasons. The bridges 54, 56 are arranged at an axial end of each slot 16, 18 and formed such that they act together with the respective recesses 46, 48 of the vanes 22, 24 (see FIG. 2 in particular). The bridges 54, 56 form abutments 64 for the vanes 22, 24 (see FIG. 3). The vanes 22, 24 are able to come into contact with the abutment 64 of the bridges 54, 56 with the bottom 47 of the recess 46, 48. Therefore, the vanes 22, 24 are restricted in the movement into the direction of the bridges 54, 56. The bridges 54, 56 do not have the same height $H_R$ as the rotor 10, but have a reduced height $H_B$. Therefore, above and below the bridges 54, 56 there is a space for receiving a fork end 70 of each vane 22, 24, which is formed by two legs 72, 74 (see FIG. 7), which are spaced by the recess 46, 48. These legs 72, 74 can slide above and below the bridges 54, 56. Dependent on the length of the fork end 70 it might happen that during a startup phase, e.g. the first revolution, the fork end 70 contacts the wall 12. During normal operation such a contact is not preferred. In a preferred embodiment, the abutments 64 may be provided with biasing means 65, as e.g. an oil supply 66, supplying oil for acting against the abutment 47 of the vanes 22, 24.

Figure 3:
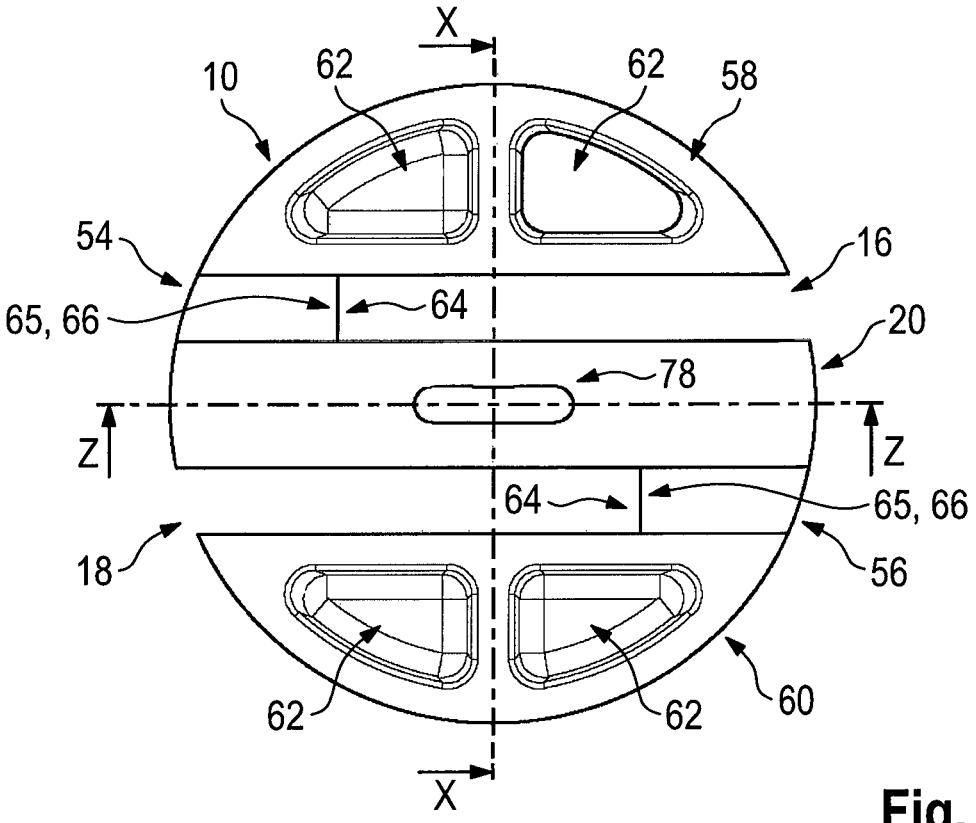
FIG. 3 shows a top view of a rotor of a vacuum pump.
Figure 4:
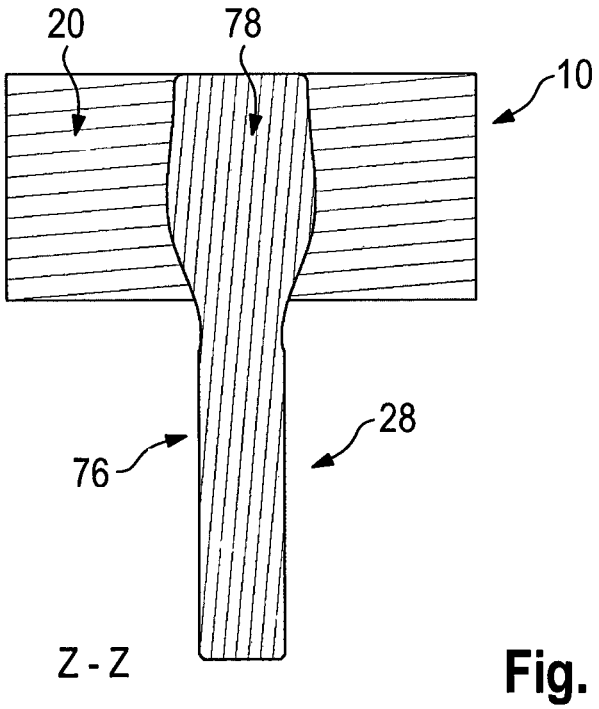
FIG. 4 shows a cut along Z-Z of FIG. 3.
Figure 5:
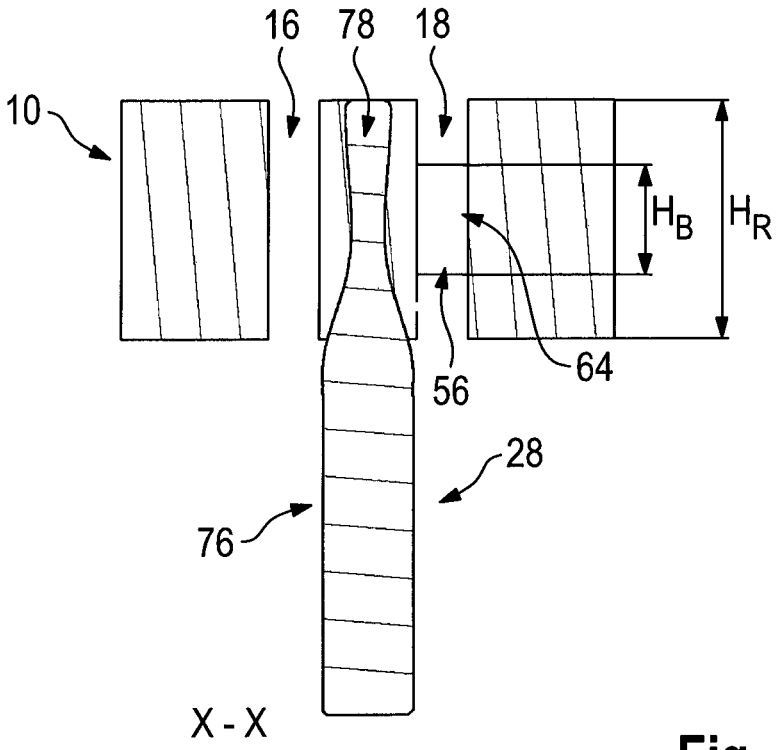
FIG. 5 shows a cut of the rotor along X-X of FIG. 3.
Figure 6:
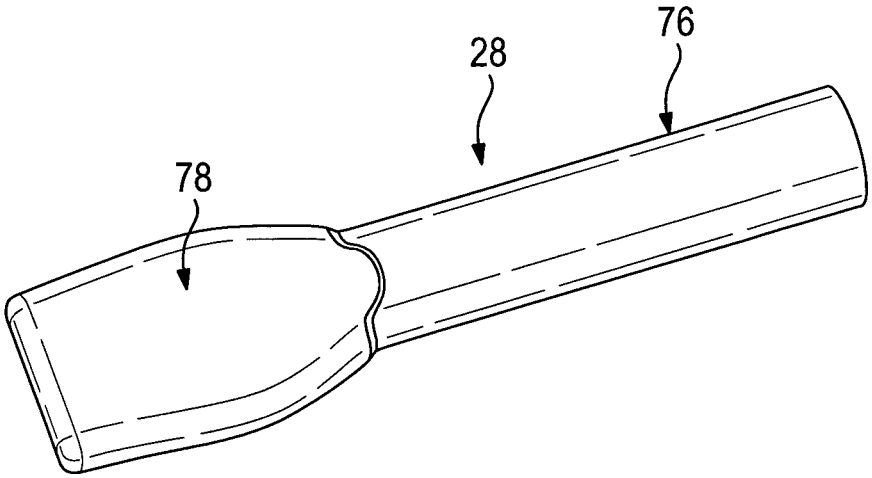
FIG. 6 shows a perspective view of a drive shaft.

The rotor 10 is attached to a drive shaft 28. The drive shaft 28 comprises a cylindrical shaft portion 76 and a flattened tang portion 78. Flattened tang portion 78 is formed by forging, while a cylindrical pin is used as the raw material for forming the drive shaft. The flattened tang 78 is formed such that it can be received in the central block portion 20 of the rotor as can be seen in FIGS. 3 to 5. In particular the rotor 10 is formed on the drive shaft 28 by means of an over molding process, such that a formfitting attachment between the rotor 10 and the tang portion 78 of the drive shaft 28 is achieved. This is a very simple manner for mounting the rotor to a drive shaft.

Figure 8:
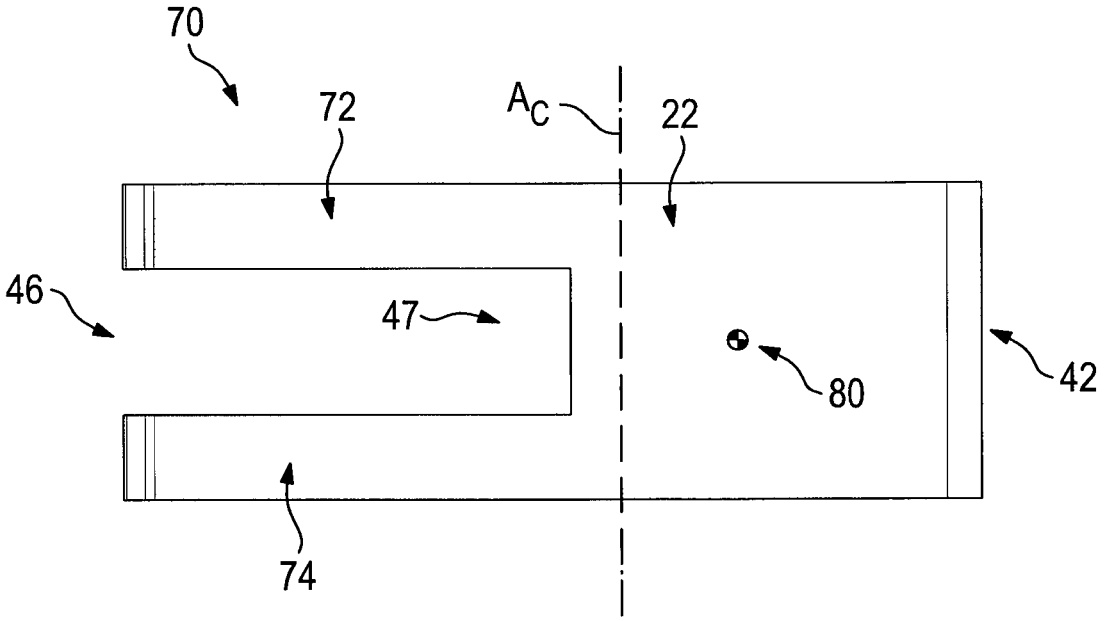
FIG. 8 shows a side view of the vane of FIG. 7.

Due to the special design of the vanes 22, 24, the center of gravity 80 is offset from the central axis $A_C$ of the vanes 22, 24 into the direction of the vane tip 42, 44 (see FIG. 8). This is due to the recess 46, 48. Moreover the legs 72, 74 are provided with an additional recess 82 thus again reducing the material at the fork end 70 of the vanes 22, 24. The center gravity 80 is preferably but not necessarily placed at such a point at the vanes 22, 24 that it does not cross a plane which is perpendicular to the slots 16, 18. This plane is equal to plane X-X shown in FIG. 3. When the vane 22 would be placed in slot 16 (see FIGS. 1 and 2) the center of gravity 80 (see FIG. 8) would not travel with respect to FIG. 3 to the left side beyond plane X-X. Thus, when the rotor 10 is in rotation, the vanes 22, 24 will be pushed outwardly and the vane tips 42, 44 into contact with the inner circumferential wall 12, due to centrifugal force. Preferred ranges of operation are e.g. approximately 300-3500 RPM for camshaft applications and approximately 600-7000 RPM for sump mounted applications.

Both vanes 22, 24 can move independent from each other. Therefore, the chamber profile which is defined by the inner circumferential wall 12 can be designed with a high degree of freedom.

Figure 9:
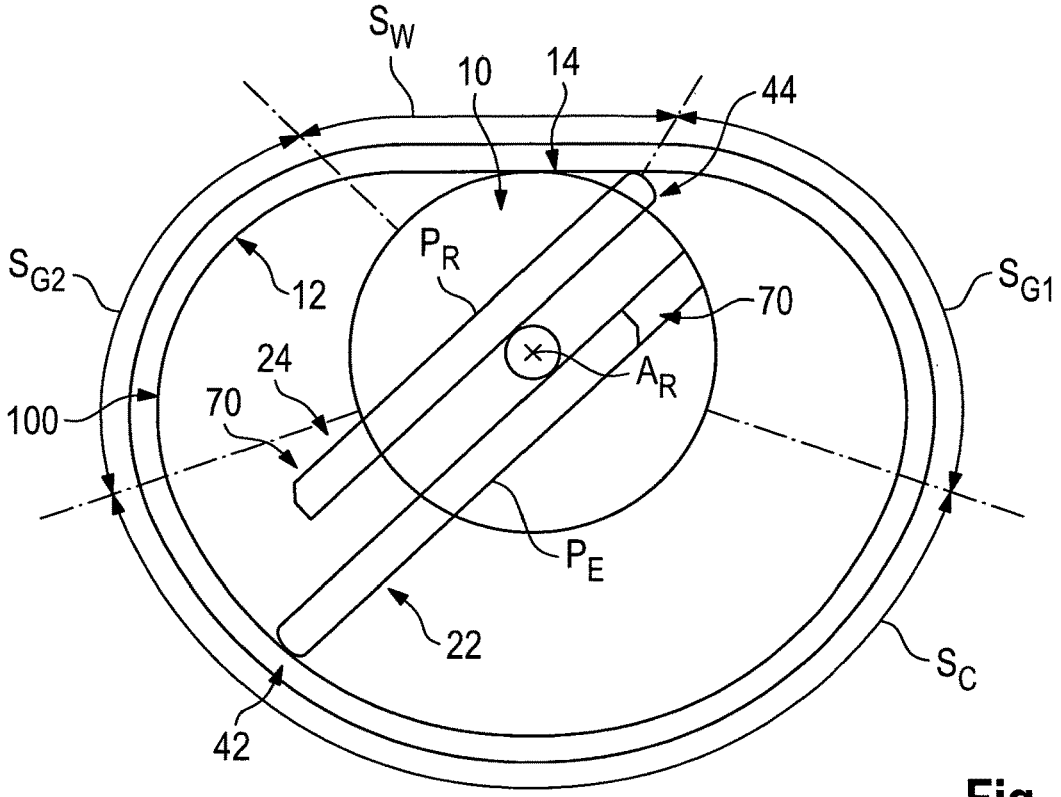
FIG. 9 shows a schematic of a profile of a chamber.
Figure 10:
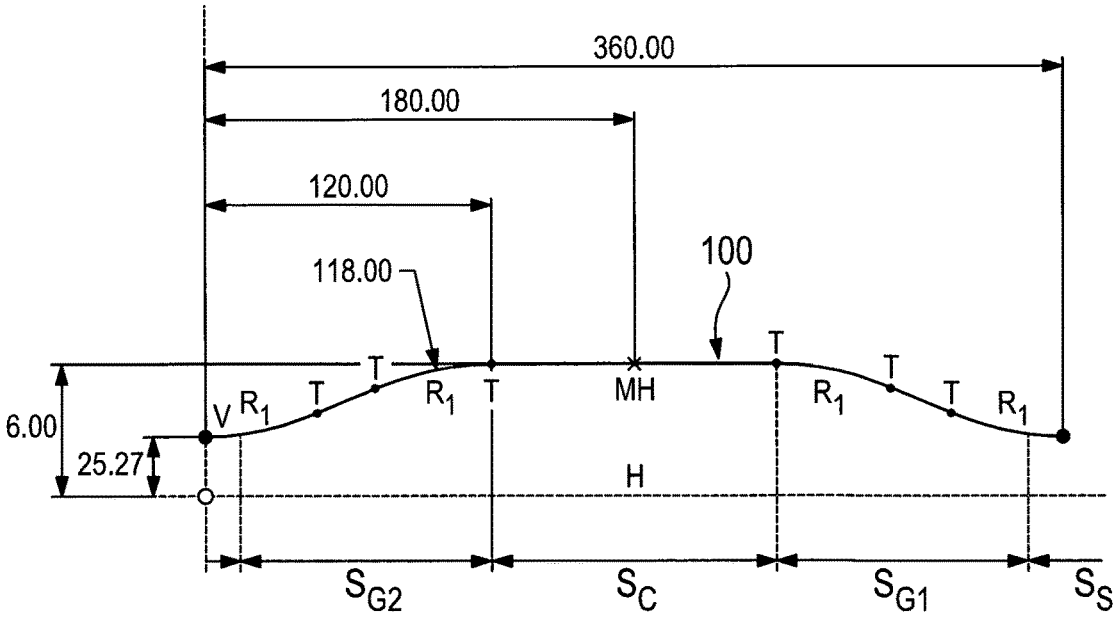
FIG. 10 shows a graph of the position of the vane tip dependent on the rotation of the rotor.

Now turning to FIGS. 9 and 10 the chamber profile 100 will be explained. FIG. 9 shows a schematic view of the inner circumferential wall and the chamber profile 100. Moreover, the rotor 10 is shown which is rotatable about the rotor axis $A_R$ and has two vanes 22, 24. Vane 22 is in the maximum extended position $P_E$ and vane 24 is almost completely retracted and almost in the retracted position $P_R$. As can be seen from FIG. 9, when the vane tip 44 of the vane 24 is close to the contact point 14, at which the vane tip 42, 44 completely retracts into the respective slot 16, 18, the fork end 70 of the vane 22, 24 projects out of the rotor 10 at the opposite side of the respective vane tip 42, 44. In the extended position (vane 22 in FIG. 9) the fork end 70 is within the rotor 10, however to a relatively large extent, such that the fork end provides a support or bearing for the vanes 22, 24 so that tilting or canting is prohibited.

The chamber profile 100 (see also FIG. 10) is designed such that the volume of the chamber 8 is maximized and such that the vanes 22, 24 are in the extended position as long as possible. To achieve this, the profile 100 comprises a circular shaped portion $S_C$ which extends about 120° of a rotor revolution. This can be inferred from FIG. 10 in which the position of the vane tip 42, 44 is drafted on the ordinate and the respective rotor revolution on the abscissa. The circular portion $S_C$ is thus shown as a straight line in the graph in FIG. 10. Moreover, the chamber profile 100 comprises a widening portion $S_W$ which is provided in the range of the contact point 14. This widening portion $S_W$ helps to bring out the vane tips 42, 44 very fast at the beginning of a revolution and bring them in at the end of the revolution. The widening portion may be formed substantially planar or straight, which also allows a slight depression or slight curvature with a relatively large radius. Between the widening portion $S_W$ and the circular portion $S_C$ two gradient portions $S_{G1}$ and $S_{G2}$ are provided, in which the vane tips 42, 44 are moved outwardly. The gradient portions $S_{G1}$ and $S_{G1}$ are formed such that the force between the vane tips 42, 44 and the inner circumferential wall 12 quickly reaches a desired value so that a sealing grade between the vanes 22, 24 and the inner circumferential wall 12 is high. Of course it is also possible to use a circular chamber profile. In such an embodiment the present invention has the advantage that the rotor diameter can be reduced i.e. the maximum vane extension is larger, such that the chamber volume is large with respect to standard vacuum pumps. A circular chamber profile 100 means that the vanes 22, 24 are constantly gently accelerating radially in one or another direction. This chamber will not package a given swept volume as efficiently but the cost advantage may be more significant.

Figure 11:
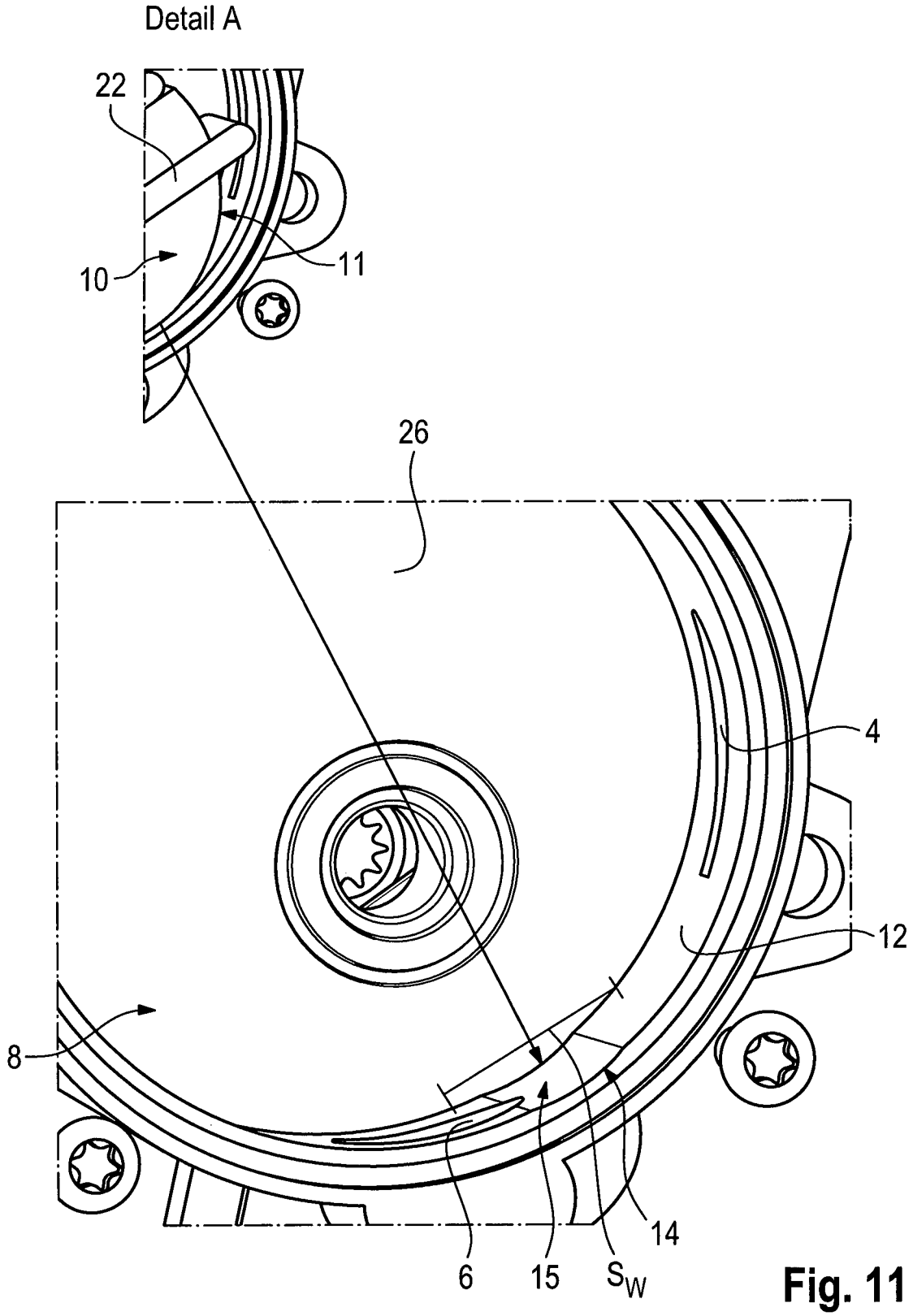
FIG. 11 shows a cut perspective view of a chamber without rotor.

In FIG. 11 such a chamber 8 with a substantially circular profile 100 is shown. The chamber 8 is shown without rotor 10; in the left upper corner of FIG. 11 the rotor 10 placement is illustrated in Detail A. The inner circumferential wall 12 forms a sealing contact point 14 with the rotor 10, as described with respect to FIG. 1 above. In the embodiment of FIG. 11 this contact point 14 is formed as a slight depression 15 which has a circular profile to meet the outer circumference 11 of the rotor 10. Around this depression 15 the widening portion $S_W$ is provided. In this portion $S_W$ the vanes 22, 24 are accelerated to move fast into the extended position $P_E$ or the retracted position $P_R$, so that the vanes 22, 24 can stay extended for as long as possible.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 vacuum pump
2 housing
4 inlet
6 outlet
8 chamber
10 rotor
11 outer circumference
12 inner circumferential wall
14 contact point
15 depression
16 first slot
18 second slot
20 block portion
22 first vane
24 second vane
26 bottom wall
28 drive shaft
30 block
32 coupling
34 recess
36 formfitting means
38 valve assembly
40 hose connector
42, 44 vane tip
46, 48 recess
47 abutment
50 cover
52 means of screws
54, 56 bridge
58, 60 side portion
62 recess
64 abutment
65 biasing means
66 oil supply
70 fork end
72, 74 leg
76 shaft portion
78 flattened tang portion
80 center of gravity
100 chamber profile
$A_R$ rotational axis
$A_{S1}$, $A_{S2}$ longitudinal axis of vane
$D_R$ diameter of the rotor
$H_B$ reduced height
$H_R$ height of rotor
$L_E$ external vane length
$L_V$ length of vane
$L_S$ length of slot
O offset
$P_E$ extended position
$P_R$ retracted position
$R_R$ radius of the rotor
$S_C$ circular shaped portion
$S_W$ widening portion
$S_{G1}$, $S_{G2}$ gradient portion
X-X radial plane

The invention claimed is:

1. A vacuum pump, comprising:
a housing having an inlet and an outlet;
a chamber within the housing;
a rotor configured to undergo rotational movement about a rotational axis within the chamber, and
at least a first vane and a second vane, the first vane and the second vane being received, respectively, in a first slot and a second slot, the first slot and the second slot being formed in the rotor,
wherein the first slot and the second slot are substantially parallel to each other,
wherein a length of the first vane is greater than a length of the first slot,
wherein a length of the second vane is greater than a length of the second slot, and
wherein the first slot and the second slot are formed as secants and are symmetrical to each other about the rotational axis of the rotor.

2. The vacuum pump according to claim 1,
wherein the length of the first vane and the length of the second vane are greater than a diameter of the rotor.

3. The vacuum pump according to claim 2, wherein a ratio of a maximum length of a portion of the first vane external to the first slot to a radius of the rotor is between 1 and 1.3.

4. The vacuum pump according to claim 2, wherein a center of gravity of each of the first vane and the second vane is offset towards a respective vane tip.

5. The vacuum pump according to claim 2, further comprising biasing means configured to bias at least the first or the second vane into an extended position.

6. The vacuum pump according to claim 2, wherein the biasing means comprise an oil supply to an abutment of one or more of the first vane and the second vane.

7. The vacuum pump according to claim 2, wherein the chamber comprises a chamber profile having a circular arc portion corresponding to a section in a range of at least 90° to 135°.

8. The vacuum pump according to claim 7, wherein the chamber profile comprises a widening portion corresponding to a section in a range of 10° to 40°.

9. The vacuum pump according to claim 2, wherein the rotor is connected to a drive shaft by over moulding.

10. The vacuum pump according to claim 9, wherein the shaft comprises a flattened tang portion extending into a central solid portion of the rotor.

11. A vacuum pump, comprising:

a housing having an inlet and an outlet;

a chamber within the housing;

a rotor configured to undergo rotational movement about a rotational axis within the chamber, and at least a first vane and a second vane, the first vane and the second vane being received, respectively, in a first slot and a second slot, the first slot and the second slot being formed in the rotor, wherein the first slot and the second slot are substantially parallel to each other, wherein a length of the first vane is greater than a length of the first slot, wherein a length of the second vane is greater than a length of the second slot, wherein the rotor comprises first and second bridges, and wherein the first bridge intersects the first slot and the second bridge intersects the second slot for connecting opposing portions of the rotor.

12. The vacuum pump according to claim 11, wherein the first vane comprises a first recess that corresponds to the first bridge and the second vane comprises a second recess that corresponds to the second bridge such that the first vane and the second vane are able to slide, respectively, within the first slot and the second slot.

13. The vacuum pump according to claim 12, wherein the first bridge and the second bridge form abutments for restricting movement of the first vane and the second vane.

14. The vacuum pump according to claim 13, wherein the abutments are formed such that a center of gravity of the first vane and a center of gravity of the second vane are always kept on a same side of a radial plane through the rotor perpendicular to the first slot and the second slot.

15. A production method for manufacturing a vacuum pump comprising:

providing a housing having an inlet and an outlet, the housing defining a chamber therein;

providing a drive shaft;

over moulding a rotor on the drive shaft, the rotor having a first slot and a second slot, wherein the first slot and the second slot are substantially parallel to each other; and providing a first vane and a second vane received, respectively, in the first slot and the second slot, wherein a length of the first vane is greater than a length of the first slot, wherein a length of the second vane is greater than a length of the second slot, and wherein the first slot and the second slot are formed as secants and are symmetrical to each other about a rotational axis of the rotor.

16. The production method according to claim 15, further comprising:

forging a flattened tang portion on the drive shaft before over moulding the rotor.

17. A vacuum pump, comprising:

a housing having an inlet and an outlet;

a chamber within the housing;

a rotor configured to undergo rotational movement about a rotational axis within the chamber, and at least a first vane and a second vane, the first vane and the second vane being received, respectively, in a first slot and a second slot, the first slot and the second slot being formed in the rotor, wherein the first slot and the second slot are substantially parallel to each other, wherein a length of the first vane is greater than a length of the first slot, wherein a length of the second vane is greater than a length of the second slot, wherein the first slot includes a radially inner surface that extends, in a plane perpendicular to the rotational axis, from a first point on a circumference of the rotor to a second point on the circumference of the rotor thereby forming a first secant line in the plane perpendicular to the rotational axis, and wherein the second slot includes a radially inner surface that extends, in the plane perpendicular to the rotational axis, from a third point on the circumference of the rotor to a fourth point on the circumference of the rotor thereby forming a second secant line in the plane perpendicular to the rotational axis.

18. The vacuum pump according to claim 17, wherein the first secant line and the second secant line are parallel, and wherein the diameter of the rotor defines a line that lies between the first secant line and the second secant line.

19. The vacuum pump according to claim 18, wherein the rotor includes a center section that separates the first slot from the second slot, wherein a width of the center section is defined by a distance between the first secant line and the second secant line.

20. The vacuum pump according to claim 17, wherein a distance between the first and second points on the circumference of the rotor is smaller than the diameter of the rotor.

* * * * *